United States Patent [19]

Sanford

[11] 4,006,335

[45] Feb. 1, 1977

[54] PUSH-BUTTON SWITCH

[75] Inventor: Carlton E. Sanford, East Providence, R.I.

[73] Assignee: Texas Instruments Incorporated, Dallas, Tex.

[22] Filed: Mar. 3, 1975

[21] Appl. No.: 554,386

[52] U.S. Cl. ..... 200/159 B; 58/50 R

[51] Int. Cl.[2] ..... H01H 3/12

[58] Field of Search ..... 200/159 R, 159 A, 159 B, 200/83 N, 276, 61.76, 85 R, 61.45 R, 83 R, 314, 52 R, 59 R, 59 A, 59 B, 85.5, 50 R, 27 BA; 58/85.5, 50 R, 23 BA

[56] References Cited

UNITED STATES PATENTS

| | | | |
|---|---|---|---|
| 884,121 | 4/1908 | Apold | 200/85 R |
| 2,916,871 | 12/1959 | Wegner | 58/50 R |
| 3,767,875 | 12/1973 | Schneikart et al. | 200/52 R |
| 3,946,182 | 3/1976 | Holder | 200/159 B |

*Primary Examiner*—James R. Scott
*Assistant Examiner*—Morris Ginsburg
*Attorney, Agent, or Firm*—Harold Levine; John A. Haug; James P. McAndrews

[57] ABSTRACT

A push-button switch particularly adapted for use in a digital watch has an open-ended chamber formed at one end of an electrically conductive body and has a passage communicating with the chamber from the opposite end of the body, has electrically insulating spacer means secured in sealing relation to the open-chamber end supporting at fixed contact extending from the chamber through the open chamber end, has a resilient electrical contact supported on the spacer means within the chamber with the perimeter of the resilient contact in electrical engagement with the body and with a central portion of the electrical contact disposed in selected spaced relation to the fixed contact, has a flexible diaphragm secured between the resilient electrical contact and said body passage sealing the chamber opposite the open chamber end, and has a push-button operating member slidable in the body passage for selectively depressing the central portion of the resilient contact through the flexible diaphragm into electrical engagement with the fixed contact to close an electrical circuit, the body being adapted to be secured to a watch case by press-fitting into a watch case aperture.

6 Claims, 6 Drawing Figures

PUSH-BUTTON SWITCH

Electrical digital displays provided in the electronic wrist watches tend to impose relatively heavy electrical loads on the battery power supplies used in such watches and accordingly, electrical switch means are desirably mounted on the watch case in a conveniently accessible location to permit selective actuation of the watch display only where reading of the display is required. Switch means utilized for this purpose should be extremely small to permit mounting of the switch in a readily accessible location without extending so far from the watch case that the switch would tend to be snagged on clothing and without requiring excessive space within the watch case. Such switch means should be a normally open switch which freely returns to open position to assure that the switch is not inadvertently left in closed position fo any extended period of time, should provide closing of a cicuit without excessive resistance across closed switch contacts, should be sealed against the environment, should be easily sealed relative to a watch case, and should be formed of low cost materials and economically assembled.

It is an object of this invention to provide a novel and improved push-button switch; to provide such a switch which is of extremely small and compact size; to provide such a switch which is sealed against the environment, which is readily mounted in sealed relation to a watch case, and which is formed of low cost materials and adapted to be economically assembled; and to provide such a switch which is normally open and which freely returns to open position to assure that the switch is not inadvertently left in closed position for any extended period of time due to any sticking of components within the switch.

Other objects, advantages and details of the novel and improved push-button switch of this invention appear in the following detailed description of preferred embodiments of the invention the detailed description referring to the drawings in which.

Figure 1:
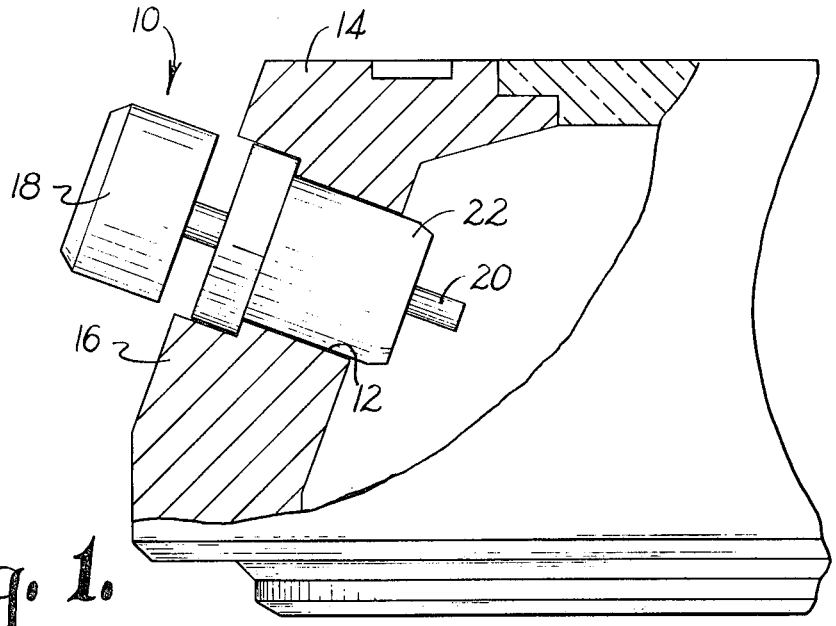
FIG. 1 is a partial side elevation view of the watch case partly cut away illustrating mounting of the switch of this invention.
Figure 2:
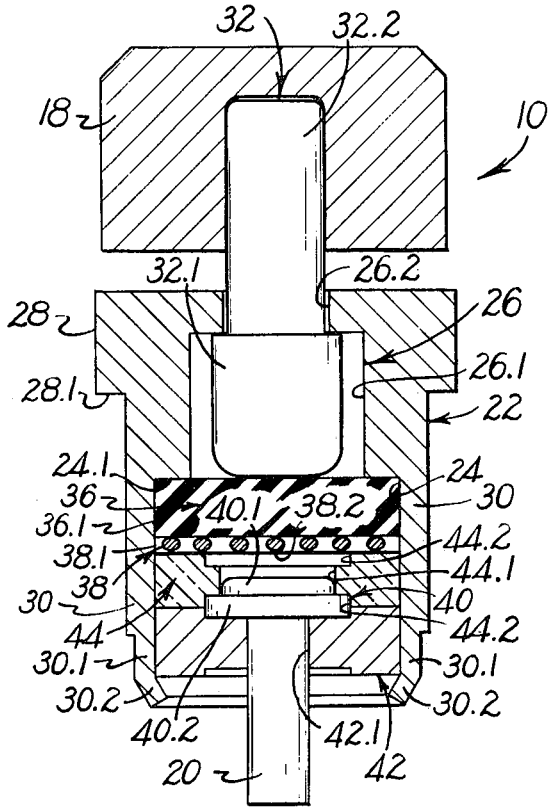
FIG. 2 is a section view along the longitudinal axis of the switch of this invention.
Figure 3:
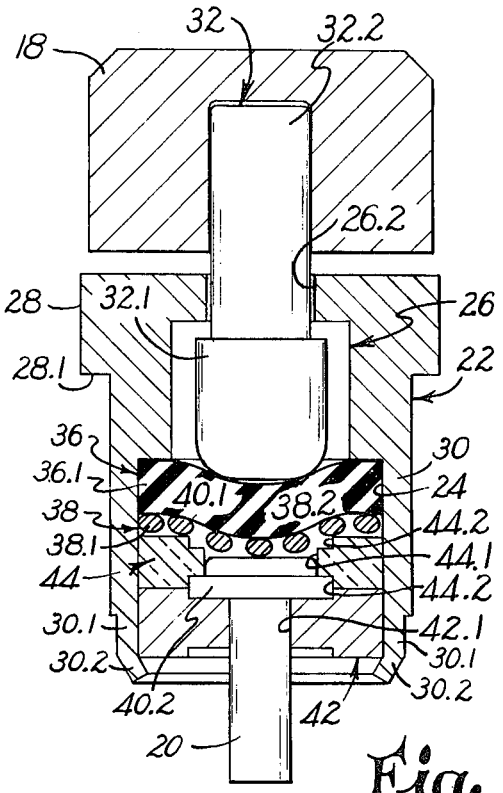
FIG. 3 is a section view similar to FIG. 2 illustrating an alternate position of the switch of FIG. 2.

Referring to the drawings, 10 in FIGS. 1–3 indicates the novel and improved push-button switch of this invention which is shown to be mounted in an aperture 12 in the side of a watch case 14, the watch case being provided with a slight slope on an outer surface 16 and the switch 10 being sufficiently small and compact to be mounted at the location of this sloping case surface with a push-button 18 at one end of the switch disposed to be accessible from the watch exterior and with a switch terminal 20 extending conveniently into the interior of the watch case. As will be understood, the terminal 20 is positioned to be connected to electrical circuitry (not shown) inside the watch case for permitting selectively energization of a digital watch display. Of course, the switch of this invention is adapted for use in other applications but is particularly adapted for actuation of a digital watch display as shown.

As shown, particularly in FIGS. 2 and 3, the switch 10 of this invention includes a generally cylindrical, electrically conductive body 22 preferably formed of brass or steel or the like having an open-ended chamber 24 formed at one end of the body and having a passage 26 communicating with the chamber 24 from the opposite end of the body. Preferably as shown, the passage 26 includes a relatively larger diameter portion 26.1 adjacent the chamber 24 and a relatively smaller diameter portion 26.2 at said opposite end of the body. Preferably also the body is provided with a flange 28 forming a shoulder 28.1 at said opposite body end. As shown, the open-ended chamber 24 is large relatively to the body diameter so that the chamber walls 30 are relatively thin and if desired, these walls 30 are made even thinner immediately adjacent to the open chamber end as indicated at 30.1. As will be understtod, the body 22 is particularly adapted for very low cost manufacture on a screw machine or the like. As shown, the switch 10 also includes an operating member 32 which is freely slidable for at least a limited degree of axial movement in the body passage 26, the operating member having a relatively large diameter portion 32.1 in the larger diameter portion 26.1 of the passage and a stem portion 32.2 extending out of the smaller passage portion 26.2. In this arrangement, a push-button cap 18 is readily secured to the stem 32.2 of the operating member by press-fitting or cementing or in other convenient manner.

Figure 4:
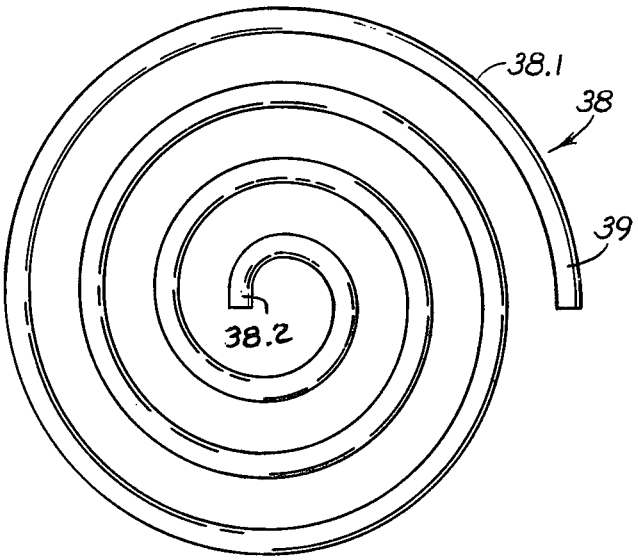
FIG. 4 is an enlarged plan elevation view of the component of the switch of FIG. 2.
Figure 5:
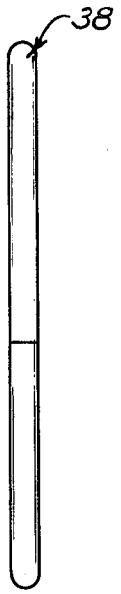
FIG. 5 is a side elevation view of the component shown in FIG. 4.

In accordance with this invention, a flexible diaphragm 36, preferably formed of any suitably pliable and slightly compressible elastomer such as ethylene propylene is disposed within the open-ended chamber 24 to rest against the shoulder 24.1 of the chamber with the perimeter 36.1 of the diaphragm preferably resting against the walls 30 of the chamber. A resilient electrical contact 38 is then disposed within the chamber 24 to rest on the diaphragm to serve as a movable switch contact. Preferably the resilient electrical contact 38 comprises a flat spiral spring such as is described in the commonly assigned, copending application of Sanford and Kleven, Ser. No. 554,385. Preferably, as is best shown in FIGS. 3 and 4, the spring 38 is wound from conventional round spring wire 39 on conventional spring coiling equipment and is then flattened by coining to provide the spring structure illustrated in FIGS. 3 and 4. Desirably, the spring is formed of copper or tin-plated stainless steel spring wire. In this arrangement, the spring 38 is proportioned so that when pressed into the chamber 24, the spring is radially compressed to a small extent so that the perimeter 38.1 of the spring is held firmly in electrical engagement with the walls 30 of the chamber 24.

In accordance with this invention, a fixed contact member 40 is preferably mounted within the open-ended chamber 24 in electrically insulated relation to the body 22 by use of electrically insulating spacer means 42 and 44. That is, the fixed contact member 40 is preferably provided with a contact surface portion 40.1 of selected diameter upstanding from a relatively larger diameter flange portion 40.2 of the contact, the fixed contact preferably being formed integral with the switch terminal 20 which extends axially and longitudinally from the flange portion of the contact. As can be seen, the fixed contact 40 is thus adapted for convenient and inexpensive manufacture by screw machine or the like. The spacer means 42 is provided with a central opening 42.1 to fit over the terminal 20 and the spacer 44 has a similar central opening 44.1 provided with a counterbore 44.2 at each end of this central opening. The spacer 44 is then fitted over the fixed contact with one counterbore 44.2 fitted over the flange portion 40.2 of the fixed contact to align the central opening 44.1 to permit clear electrical access to the contact surface portion 40.1 of the fixed contact. Preferably, the spacer means 42 and 44 are formed by molding a relatively rigid thermoplastic material such as glassfilled nylon or glass-filled acrylonitrile butodiene styrene (ABS) or the like. In accordance with this invention, the thin walls portions 30.1 of the chamber 24 are then rolled inwardly of the chamber 24 as indicated at 30.2 for pressing the spacer means 42 and 44, the spring 38, and the diaphragm 36 securely into position within the chamber 24.

In this way, the switch 10 is provided with a very small and compact size and is adapted for convenient and inexpensive assembly. That is, after formation of the switch body in inexpensive manner, the operating member is conveniently positioned in the body passage 26. The diaphragm 36, and the spring 38 as well as the contact 40 and the spacers 44 and 42 are then inserted into the body chamber 24 in sequence and the walls 30.1 of the chamber are rolled inwardly. In this arrangement, the diaphragm 36 is compressed against the bottom 24.1 of the chamber 24 for sealing that end of the chamber from the passage 26. The perimeter of the spring 38 is also held firmly in position in electrical engagement with the walls 30 of the chamber and the central portion of the spring is disposed in selected spaced relation to the contact surface portion 40.1 of the fixed contact, the fixed contact also being held securely in place within the chamber in electrically insulated relation to the body 22 with the spacers 42 and 44 being secured in sealing relation to the chamber walls 30 and to the fixed contact 40 for sealing the open end of the chamber 24. Accordingly, when the push-button cap 18 is manually depressed, the operating member 32 freely slides in the body passage 26 to flex the diaphragms 36 as shown in FIG. 2 and to move the central portion 38.2 of the flat spiral spring into firm electrical engagement with the contact surface 40.1 of the fixed contact, thereby to close an electrical circuit between the switch body 22 and the fixed contact. Upon release of the manual pressure on the push-buttom cap 18, the spring 38 and the diaphragm 36 return to their original normally open switch position as shown in FIG. 1 as a result of their inherent resilience and, because the operating member passage is sealed without requiring any sliding seal along the length of the operating member (as where an O-ring or the like might have been used to seal the passage 26), the operating member freely returns to is open circuit position. In this way, the spring contact 38 provides excellent, low resistance electrical engagement with the fixed contact 40 and is adapted to display an extremely long cycle life while providing complete ease in closing a circuit and while assuring that the switch freely returns to normally open circuit position when manual pressure on the switch is released. Further, various components of the switch including the diaphragm 36, the spring contact 38, and the spacers 42 and 44 are configured so that, as illustrated in the drawings, the components are mountable with either side in the illustrated disposition, thereby to facilitate assembly of the switch at low cost. The switch body 22 is also adapted to be easily press-fitted into an aperture in a watch case with the flange shoulder 28.1 of the body engaging a shoulder on the watch case for properly locating the switch on the case in sealed relation to the case.

Figure 6:
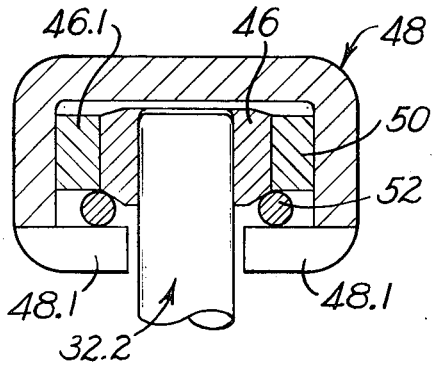
FIG. 6 is a partial section view similar to FIG. 2 illustrating an alternate embodiment of the switch of this invention.

In this latter regard, an alternate embodiment of the switch 10 as shown in FIG. 6 is desirably used for facilitating mounting of the switch 10 on a watch case. That is, as is shown in FIG. 6, in this alternate embodiment of the switch 10, the push-button cap 18 is omitted and a ferrule 46 is press-fitted or cemented onto the stem portion 32.2 of the switch operating member. After securing of the diaphragm, spring contact, spacer means and fixed contact of the switch in the switch body as above-described, the switch body 22 is press-fitted into the noted watch case aperture by applying pressure onto the flange portion 28 of the body. Then, after the switch body has been mounted on the watch case, an alternate cup-shaped push-button cap 48 is provided, this cap preferably being of a drawn steel or brass construction having a linear ring 50 pressed into the cap, having a C-shaped spring 52 or the like disposed within the cap, and having cap tabs 48.1 turned inwardly at the open end of the cup-shaped cap for retaining the spring within the cap. This cap structure is then mounted on the stem portion of the operating member by pressing the structure over the ferrule 46 so that the spring 52 is spread apart to fit over and to capture the ferrule for retaining the cap structure on the operating member. As shown the ferrule is preferably tapered as at 46.1 to facilitate this moving of the spring 52 over the ferrule, to permit the ferrule to be easily assembled with either side up, and to provide a sloping surface for engagement with the spring 52 to obviate any need for adjustment of the cap retention while assuring secure, rattle-free positioning of the cap on the operating member.

It should be understood that although preferred embodiments of the switch of this invention have been described by way of illustrating the invention, various modifications of the illustrated switch structure can be made within the scope of this invention. For example, other generally flat spring contact structures could be secured between the diaphragm 36 and the spacer means 42 and 44; and the spacer means could be formed as a single unit and could be formed of glass material heat-sealed into the open end of the switch body chamber 24. This invention includes all modifications and equivalents of the disclosed switch structure falling within the scope of the appended claims.

I claim:

1. A push-button electrical switch comprising an electrically conductive body having an open-ended chamber formed at one end of the body and having a passage communicating with the chamber from the opposite end of the body, a fixed electrically conductive contact, electrically insulating spacer means secured in sealing relation to the body and to the fixed contact at the open end of the body chamber supporting the fixed contact extending from the body chamber through the open chamber end in electrically insulated relation to the body, spring contact means on said spacer means within the body chamber having the perimeter of the spring contact means in electrical engagement with the body and having a central portion of the spring contact means normally disposed in selected spaced relation to the fixed contact, an elastomer diaphragm secured between the spring contact means and the body passage sealing the body chamber opposite from the open end of the chamber, and an operating member slidable in the body passage and extending from the opposite end of the body to be manually moved for selectively pressing the diaphragm to move the central portion of the spring contact means into electrical engagement with the fixed contact to close an electrical circuit between the fixed contact and the electrically conductive body.

2. A push-button electrical switch comprising a generally cylindrical, electrically conductive body having an open-ended chamber formed at one end of the body and having a passage communicating with the chamber from the opposite end of the body, a fixed electrically conductive contact, electrically insulating spacer means, secured in sealing relation to the body and to the fixed contact at the open end of the body chamber supporting the fixed contact with a portion within the body chamber in electrically insulated relation to the body and with a terminal portion extending from the open end of the chamber, electrically conductive resilient spring means mounted on the spacer means within the body chamber with the perimeter of the spring means in resilient electrical engagement with the body and with a central portion of the spring means disposed in selected spaced relation to the fixed contact portion within the chamber, an elastomer diaphragm secured within the chamber between the spring means and the body passage sealing the body chamber opposite from the open end of the chamber, and an operating member slidable in the body passage and extending from the body to be manually pressed for selectively pressing the diaphragm to move the central portion of the spring means into electrical engagement with the fixed contact portion within the body chamber to close an electrical circuit between the fixed contact and the electrically conductive body.

3. A push-button switch as set forth in claim 2 wherein said body passage has a first portion of selected diameter adjacent the body chamber forming a body shoulder within the body chamber, and has a second relatively smaller diameter portion open at said opposite body end, wherein the elastomer diaphragm is secured against said body shoulder for sealing said chamber, and wherein the operating member has a first diameter portion disposed in said first passage portion and has a relatively smaller diameter stem portion extending from the body through the second portion of the body passage for limiting slidable movement of the operating member within the body passage.

4. A push-button switch as set forth in claim 2 wherein the fixed contact has a contact surface portion of selected diameter upstanding from a flange portion of relatively larger diameter and has a contact terminal portion extending axially from the flange portion of the contact and wherein the spacer means includes a first, electrically insulating spacer ring having a central aperture fitted over the terminal portion of the contact and a second electrically insulating spacer ring having a central aperture of selected diameter and a counter base of relatively larger diameter fitted over the flange portion of the fixed contact, the spacer rings being secured in sealed relation to the body at the open end of the body chamber for permitting electrical access to the contact surface portion of the contact within the chamber and for permitting the contact terminal portion to extend from the body chamber.

5. A push-button switch as set forth in claim 3 wherein a push-button cap is secured to the stem portion of the operating member outside the body passage.

6. A push-button switch as set forth in claim 3 wherein a ferrule is secured to the stem portion of the operating member outside the body passage, wherein a cup-shaped push-button cap is provided with an inner ring, with a C-shaped spring disposed within the cap, and with rim tabs retaining the C-shaped spring within the cup-shaped cap, the cap being disposed over the ferrule on the operating member stem with the C-shaped spring fitted over the ferrule for retaining the cap on the operating member stem portion.

* * * * *